United States Patent [19]

Petersen

[11] 4,379,550

[45] Apr. 12, 1983

[54] GROUND SUPPORTED PLAYGROUND DEVICE

[75] Inventor: Tom L. Petersen, Fruens Böge, Denmark

[73] Assignee: Multikunst Legepladser I/S, Ringe, Denmark

[21] Appl. No.: 56,147

[22] Filed: Jul. 9, 1979

[51] Int. Cl.[3] ..... A63G 17/00

[52] U.S. Cl. ..... 272/52; 52/166

[58] Field of Search ..... 272/52, 52.5, 53.1, 272/53.2, 54, 55, 50, 51, 110, 78; 248/352, 624, 163, 188.1, 188; 52/299, 292, 166; 182/15; 273/25; 297/175, 176, 177, 178, 179

[56] References Cited

U.S. PATENT DOCUMENTS

| | | | |
|---|---|---|---|
| 554,215 | 2/1896 | Carlson | 272/33 R |
| 1,280,445 | 10/1918 | Grace | 248/163 X |
| 1,346,933 | 7/1920 | Barber | 52/166 |
| 1,559,476 | 10/1925 | Troike | 272/50 |
| 2,408,337 | 9/1946 | Panzer | 248/188 |
| 2,446,949 | 8/1948 | Neutra | 52/292 |
| 2,638,231 | 5/1953 | Tardie et al. | 52/166 X |
| 2,769,484 | 11/1956 | Kairath | 272/52 |
| 2,993,530 | 7/1961 | Little et al. | 272/52 |
| 2,996,298 | 8/1961 | Grosse et al. | 272/52 |
| 3,157,256 | 11/1964 | Latta, Jr. | 52/166 |
| 3,262,406 | 7/1966 | Nickolaisen | 248/163 X |
| 3,365,194 | 1/1968 | Strickland, Jr. | 272/50 UX |
| 3,475,019 | 10/1969 | Mutter et al. | 272/55 |
| 4,014,517 | 3/1977 | Keagle | 248/352 X |
| 4,093,198 | 6/1978 | Petersen | 272/52 X |

FOREIGN PATENT DOCUMENTS

| | | | |
|---|---|---|---|
| 457105 | 9/1929 | Fed. Rep. of Germany | 272/54 |

*Primary Examiner*—Richard C. Pinkham
*Assistant Examiner*—Arnold W. Kramer
*Attorney, Agent, or Firm*—Craig & Burns

[57] ABSTRACT

A playground device mounted on a support such as a heavy coil spring, the lower end of which is fastened to a ground anchor which is a lightweight construction comprising a lowermost horizontal plate member adapted to be buried in a hole in the ground and a number of substantially vertical legs connecting this plate member with an upper mounting member adapted to be located in the ground surface level and stabilized in this location by said hole being refilled with earth, the mounting member serving to rigidly hold the lower end of the support of the playground device.

1 Claim, 3 Drawing Figures

GROUND SUPPORTED PLAYGROUND DEVICE

Figure 1:
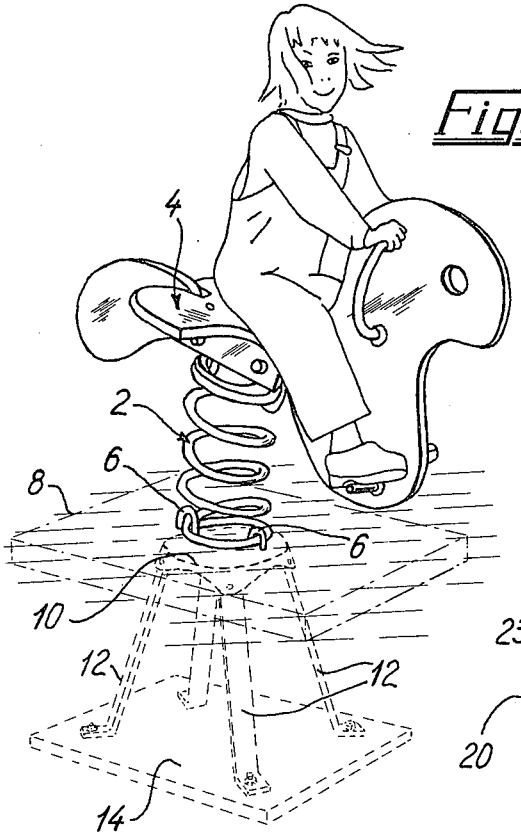

This invention relates to a playground device of the type carried on a heavy coil spring or a similar support which, in use, is likely to be subjected to tilting or displacement forces, preferably a resilient rocking device comprising a seat mounted on the top of a heavy, vertically disposed coil spring, the lower end of which is rigidly secured in ground level to a base anchoring member. A child using such a device may cause it to rock resiliently in all horizontal directions, provided, of course, that the lower end of the coil spring is immovably anchored to the ground by means of said anchoring member. The most common type of anchoring member is a heavy concrete tile, provided with holes for receiving fastening bolts for the firm holding of the lower coil spring end. Such an anchoring member is perfectly usable, but the requirements as to the provision of the said holes and the dimensions of the tile normally involve that the heavy tile should be provided by the manufacture of the playground device itself and be shipped along with the device, this of course giving rise to considerably increased shipping costs due to the dominating weigth of the tile, despite its character of a very simple product. In many cases a firm initial ground anchoring may be achieved without the use of a heavy element, viz. by means of poles or ground spears holding the support against the ground surface, but such arrangements tent to get loose when they have been in use for some time.

It is the purpose of the invention to provide an improved anchoring structure which does not comprise really heavy elements, so as to be easy to ship, and which is capable of offering a rigid and durable anchoring of the playground device.

According to the invention this is obtained by designing the anchoring means to comprise a lightweight mounting member for holding the lower end of the support generally in the ground surface level and provided with mutually spaced, downwardly projecting leg members which, at their respective lower ends, are secured to lightweight plate means which are mounted or mountable in a generally horizontal, subterranean position. For anchoring a device according to the invention it will be required to dig a hole large and deep enought to receive the said plate means at a depth corresponding to said mounting member being located approximately in the ground surface level, but once this is done and the hole is again filled with earth thus deposited on the top side of the buried plane means, the earth pressure on the plate means will ensure a firm and durable holding of the plate means and thereby of the entire anchoring structure. All parts of the anchoring structure may be produced as lightweight elements, including the said plate means, and they are, therefore, easily shippable. The material for holding the parts, viz. the earth as thrown back into the dug hole, need no adaption whatsoever in order to fulfil its holding function.

In a preferred embodiment the said mounting member, leg members and lower plate member are provided as separate units adapted to be shipped in a compact condition and to be easily joinable at the mounting site.

Figure 2:
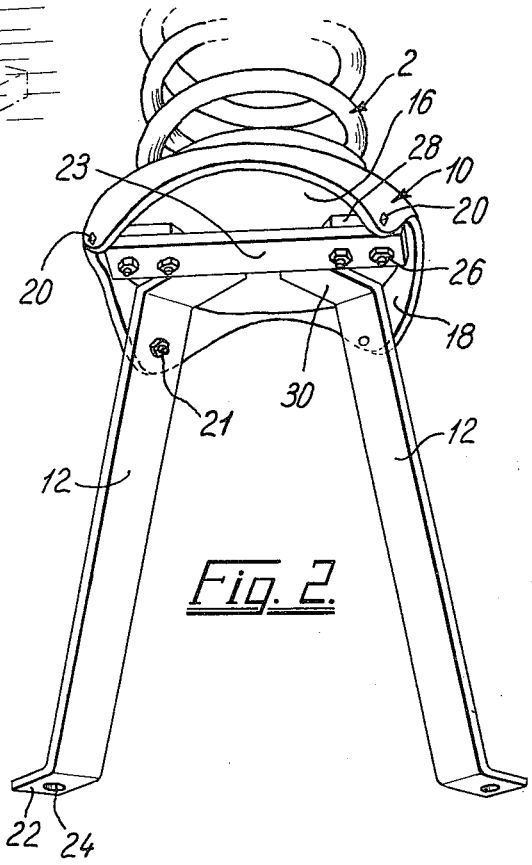
Figure 3:
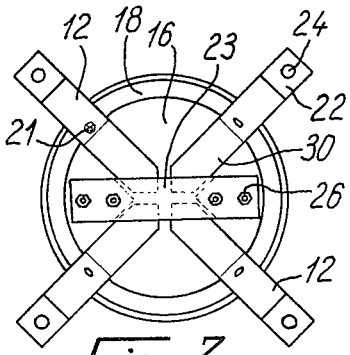

In the following the invention is described in more detail, by way of example, with reference to the accompanying drawings, in which:

FIG. 1 is a general perspective view of a playground device according to the invention, FIG. 2 is a perspective view, seen from below, of the anchoring means in partly assembled condition, and FIG. 3 is a plan bottom view of the structure shown in FIG. 2.

The device shown in FIG. 1 generally comprises a heavy coil spring 2, a seat structure 4 mounted rigidly on the top of the spring, and lower mounting means including a pair of inverted U-bolts 6 for anchoring the lower end of the spring in a rigid manner to a ground engaging holding arrangement such that the lower spring end is rigidly held approximately in the ground surface level, whereby a child sitting on the seat structure 4 may carry out resiliently rocking movements of the seat structure.

A conventional type of a ground engaging holding arrangement is a heavy concrete tile 8 as indicated in dot-and-dash lines, such tile having holes for receiving the ends of the U-bolts 6.

The purpose of the invention is to avoid this heavy tile, and according to the invention the tile is substituted by a lightweight mounting member 10 rigidly connected with the lower spring end by means of the U-bolts 6 and provided with a plurality of downwardly projecting leg members 12 which at their lower ends are secured to a horizontal plate member 14 also of lightweight design, preferably an impregnated wooden plate member.

For mounting the playground device a hole is dug in the ground, large enough to receive the plate member 14 in a depth corresponding to the mounting member 10 being located in or just underneath the ground level, and then the preassembled unit 2, 4, 6, 10, 12, and 14 is placed with the plate member 14 resting on the bottom of said hole, and the hole is then filled again, preferably by the dug up earth. The pressure of the earth on the plate will stabilize the same to make the mounting member 10 support the lower spring end in a fully rigid manner as desired.

As apparent from FIGS. 2 and 3 the mounting member 10 is preferably an inverted cup shaped metal sheet member having a plane top side 16 and an annular, depending edge flange 18 having at four points a mounting hole 20 for receiving a fastening bolt 21 for the top end of the respective leg members 12, these at their lower ends having an outwardly bent foot portion 22 with a hole 24 for receiving a fastening bolt for the bottom plate member 14.

Underneath the top portion 16 of the mounting member 10 is arranged a cross member 23, the opposed end portions of which having holes for receiving the ends of the U-bolts 6 and supporting tightening nuts 26 therefor. The said cross member ends are offset or backed by distance members 28 such that the central portion of the cross member 23 is spaced somewhat from the underside of the cup top portion 16. Each of the leg members 12 has an inwardly bent top portion 30, the outer end of which is receivable in the space between the central portion of the cross member 23 and the cup member top portion 16, as shown most clearly in FIG. 3, whereby the respective leg members 12 may be secured very firmly to the mounting member 10 by means of a single bolt 21 through the flange hole 20 and a corresponding hole in the leg member.

It will be appreciated that the mounting member 10, the leg members 12 and the plate member 14 are easily assembled on the mounting site of the entire device, such that the parts may be stored and shipped in a compact condition. However, it will also be appreciated that the ground anchoring structure constitutes an advantageous lightweight structure even if assembled in the playground device manufacturing enterprise, and moreover the invention will of course comprise any other manner of arranging for the lower end of the support element 2 of the playground device to be connected in a rigid manner with a lower lightweight plate element 14 or with corresponding plate element portions associated with each single of the leg members 12 in order to anchor the leg members in the ground when they are mounted in the said hole in the ground.

It will be appreciated that the pyramid shape of the leg members is highly advantageous for the stability of the anchoring system, but the legs may of course be arranged otherwise.

I claim:

1. A playground device of the type carried on resilient means for support which, in use, is likely to be subjected to tilting or displacement forces, said resilient means for support being secured to base anchoring means for firmly anchoring the lower end of the resilient means for support to the ground, characterized in that said base anchoring means comprise a lightweight mounting member for holding the lower end of the resilient means for support generally in the ground surface level and provided with mutually spaced, downwardly protecting leg members which, at their respective lower ends, are secured in lightweight plate means which are mounted or mountable in a generally horizontal, subterranean position, the mounting member is an inverted cup-shaped sheet metal member provided with holes in its depending edge flange for receiving fastening bolts for the upper ends of said leg members, and underneath the top portion of the cup member there is arranged a cross member, the opposite end portions of which are spaced from the cup top portion by distance members secured to the cup top portion by means of bolts additionally serving to hold the lower end of the resilient means for support against the cup member top side, the central portion of the cross member being spaced from the underside of the cup top portion so as to define a space in which is received the upper, inwardly bent end portions of the leg members.

* * * * *